US007624939B2

(12) United States Patent
Sugino et al.

(10) Patent No.: US 7,624,939 B2
(45) Date of Patent: Dec. 1, 2009

(54) KNEADER

(75) Inventors: Mitsuhiro Sugino, Tokyo (JP); Takashi Onizaki, Tokyo (JP); Isao Aoki, Ishinomaki (JP); Hisashi Iwabuchi, Tokyo (JP); Yoshihiko Aikawa, Shizuoka (JP)

(73) Assignees: Nippon Paper Industries Co., Ltd., Tokyo (JP); Aikawa Iron Works Co., Ltd., Shizuoka-Shi (JP)

( * ) Notice: Subject to any disclaimer, the term of this patent is extended or adjusted under 35 U.S.C. 154(b) by 155 days.

(21) Appl. No.: 11/898,546

(22) Filed: Sep. 13, 2007

(65) Prior Publication Data

US 2008/0078853 A1 Apr. 3, 2008

(30) Foreign Application Priority Data

Sep. 29, 2006 (JP) ..... 2006-267501

(51) Int. Cl.
*B02C 13/20* (2006.01)
*B02C 11/04* (2006.01)

(52) U.S. Cl. ..... 241/260; 241/261; 241/292.1

(58) Field of Classification Search ..... 241/260, 241/261, 292.1
See application file for complete search history.

(56) References Cited

U.S. PATENT DOCUMENTS 2,903,192 A * 9/1959 Clausen ..... 241/43
3,454,234 A * 7/1969 Schoeppner ..... 241/294
3,506,066 A 4/1970 Nonnenmacher
5,402,950 A * 4/1995 Blair et al. ..... 241/101.76

FOREIGN PATENT DOCUMENTS

| | | |
|---|---|---|
| DE | 27 43 552 | 4/1978 |
| GB | 20182 | 5/1913 |
| GB | 262 270 | 12/1926 |
| GB | 892506 | 3/1962 |
| GB | 1 554 512 | 10/1979 |
| WO | WO 79/00345 | 6/1979 |

OTHER PUBLICATIONS

Bruckner j: "Dispergierung" Das Papier, E. Roether KG Darmstadt, DE, VO. 42, No. 10, Oct. 1, 1988; pp. 547-550.

* cited by examiner

*Primary Examiner*—Faye Francis
(74) *Attorney, Agent, or Firm*—Manabu Kanesaka

(57) ABSTRACT

A kneader includes a casing with a papermaking material supply opening and a papermaking material outlet located below the papermaking material supply opening; at least first, second, third and fourth rotational shafts provided inside the casing; first blades attached to the first rotational shaft; second blades attached to the second rotational shaft; third blades attached to the third rotational shaft; and fourth blades attached to the fourth rotational shaft. The first rotational shaft and the second rotational shaft are located at the same height and are arranged parallel to each other, and the third rotational shaft and the fourth rotational shaft are located at the same height and are arranged parallel to each other. The third rotational shaft is located under the first rotational shaft and the fourth rotational shaft is located under the second rotational shaft, respectively.

9 Claims, 7 Drawing Sheets

KNEADER

BACKGROUND OF THE INVENTION AND RELATED ART STATEMENT

The invention relates to a kneader, especially, a kneader which increases a kneading effect.

Conventionally, kneaders, such as those shown in FIG. 2 in Japanese Utility Model Publication No. 60-156198, comprise two shafts respectively including blades in a casing with a papermaking material supply opening and a papermaking material outlet.

In the above-mentioned kneader, used paper is kneaded at the portion wherein the blades which are respectively provided in the two shafts intersect. In order to increase the kneading effect of the used paper by the kneader, the two shafts are respectively required to be made longer in a longitudinal direction. However, with the increase of the length of the shafts in a longitudinal direction, a size of the bottom portion of the kneader increases, and a space for the installation of the bottom portion of the kneader also increases.

An object of this invention is to provide a kneader which solves the above-mentioned problem.

Further objects and advantages of the invention will be apparent from the following description of the invention.

SUMMARY OF THE INVENTION

The present invention is a kneader comprising a casing with a papermaking material supply opening and a papermaking material outlet which is located below the papermaking material supply opening; at least first, second, third and fourth rotational shafts provided inside the casing; a first blade attached to the first rotational shaft; a second blade attached to the second rotational shaft; a third blade attached to the third rotational shaft; and a fourth blade attached to the fourth rotational shaft. The first rotational shaft and the second rotational shaft are the same height and in parallel with each other. The third rotational shaft and the fourth rotational shaft are the same height and in parallel with each other. The third rotational shaft is located under the first rotational shaft, and the fourth rotational shaft is located under the second rotational shaft, respectively.

In the kneader according to the first aspect of the invention, the kneader according to a second aspect of the invention includes the first blade comprising a first feed blade and a first return blade which are alternately attached to the first rotational shaft; the second blade comprising a second feed blade and a second return blade which are alternately attached to the second rotational shaft; the third blade comprising a third feed blade and a third return blade which are alternately attached to the third rotational shaft; and the fourth blade comprising a fourth feed blade and a fourth return blade which are alternately attached to the fourth rotational shaft. The first feed blade and the second return blade; and the first return blade and the second feed blade are arranged to face each other, respectively. The third feed blade and the fourth return blade; and the third return blade and the fourth feed blade are arranged to face each other, respectively. The first feed blade and the third return blade; and the first return blade and the third feed blade are arranged to face each other, respectively. The second feed blade and the fourth return blade; and the second return blade and the fourth feed blade are arranged to face each other, respectively.

In the kneader according to the second aspect of the invention, the kneader according to a third aspect of the invention includes the first feed blade and the first return blade including a tube member attached to the first rotational shaft; and a blade attached to the tube member. The blade has a tapered shape from the back end portion to the front end portion, and a flat surface which is parallel to the end surface of the tube member is formed along the blade. The first feed blade is attached to the first rotational shaft in such a way that the flat surface faces the upstream side of the papermaking materials, and the first return blade is attached to the first rotational shaft in such a way that the flat surface faces the downstream side of the papermaking materials, respectively. The second feed blade and the second return blade include a tube member attached to the second rotational shaft; and a blade attached to the tube member.

The blade has a tapered shape from the back end portion to the front end portion, and a flat surface which is parallel to the end surface of the tube member is formed along the blade. The second feed blade is attached to the second rotational shaft in such a way that the flat surface faces the upstream side of the papermaking materials, and the second return blade is attached to the second rotational shaft in such a way that the flat surface faces the downstream side of the papermaking materials, respectively. The third feed blade and the third return blade include a tube member attached to the third rotational shaft; and a blade attached to the tube member. The blade has a tapered shape from the back end portion to the front end portion, and a flat surface which is parallel to the end surface of the tube member is formed along the blade. The third feed blade is attached to the third rotational shaft in such a way that the flat surface faces the upstream side of the papermaking materials, and the third return blade is attached to the third rotational shaft in such a way that the flat surface faces the downstream side of the papermaking materials, respectively.

The fourth feed blade and the fourth return blade include a tube member attached to the fourth rotational shaft; and a blade attached to the tube member. The blade has a tapered shape from the back end portion to the front end portion, and a flat surface which is parallel to the end surface of the tube member is formed along the blade. The fourth feed blade is attached to the fourth rotational shaft in such a way that the flat surface faces the upstream side of the papermaking materials, and the fourth return blade is attached to the fourth rotational shaft in such a way that the flat surface faces the downstream side of the papermaking materials, respectively.

According to the kneader in the first aspect of the invention, the first, second, third and fourth rotational shafts are provided inside the casing. The first rotational shaft and the second rotational shaft are the same height and in parallel with each other. The third rotational shaft and the fourth rotational shaft are the same heights and in parallel with each other. The third rotational shaft is located under the first rotational shaft and the fourth rotational shaft is located under the second rotational shaft, respectively. Therefore, the volume of the space where the papermaking material is processed can be increased without increasing the space for installation of the bottom portion of the kneader. In addition, the papermaking materials which are processed are also kneaded by the first blade and the third blade; and the second blade and the fourth blade in addition to by the first blade and the second blade; and the third blade and the fourth blade while the papermaking materials which are processed reach the papermaking material outlet. As a result, the kneading effect also can be increased.

According to the kneader in the second aspect of the invention, in addition to the effect of the first aspect of the invention, the first feed blade and the second return blade; and the first return blade and the second feed blade are arranged to face each other, respectively. The third feed blade and the fourth return blade; and the third return blade and the fourth feed blade are arranged to face each other, respectively. The first feed blade and the third return blade; and the first return blade and the third feed blade are arranged to face each other, respectively. The second feed blade and the fourth return blade; and the second return blade and the fourth feed blade are arranged to face each other, respectively. Accordingly, the papermaking materials do not pass through smoothly, so that the papermaking materials stay longer inside the casing and are kneaded more by the blades. As a result, the papermaking materials can be kneaded more effectively.

According to the kneader in the third aspect of the invention, in addition to the effect of the second aspect of the invention, the blade includes the tube member attached to the rotational shaft; and the blade attached to the tube member. The blade has a tapered shape from the back end portion to the front end portion, and the flat surface which is parallel to the end surface of the tube member is formed along the blade. By turning the direction of the blade alternately, the feed blade and the return blade can be easily attached to the rotational shaft alternately.

DETAILED DESCRIPTION OF PREFERRED EMBODIMENTS

Hereunder, embodiments of a kneader of the invention will be explained with reference to the accompanying drawings.

In FIGS. 1-8, the reference alphabet N represents a kneader, and the kneader N is used for kneading papermaking materials such as, for example, used paper and waste sheets. Specifically, the kneader N kneads them in such a way that ink materials (undispersive ink such as UV and toner) which are mixed into a recycled pulp are separated from the pulp, and a casing 3 is supported on a base 1 through supporting members 2.

Figure 4:
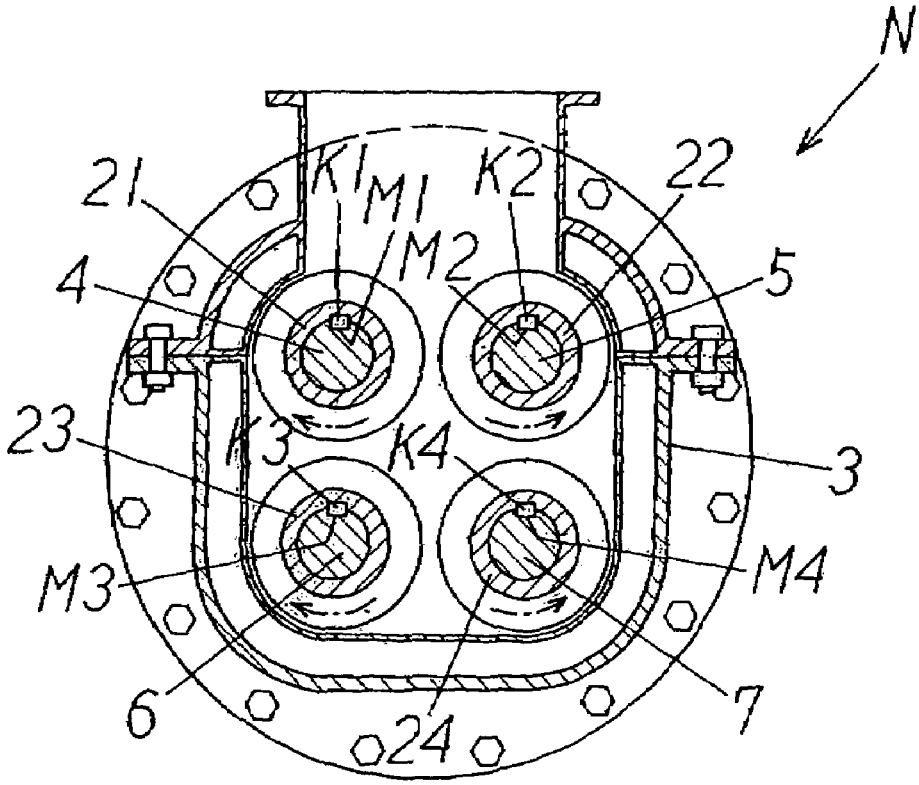
FIG. 4 is a schematic sectional view taken along line 4-4 in FIG. 2.
Figure 5:
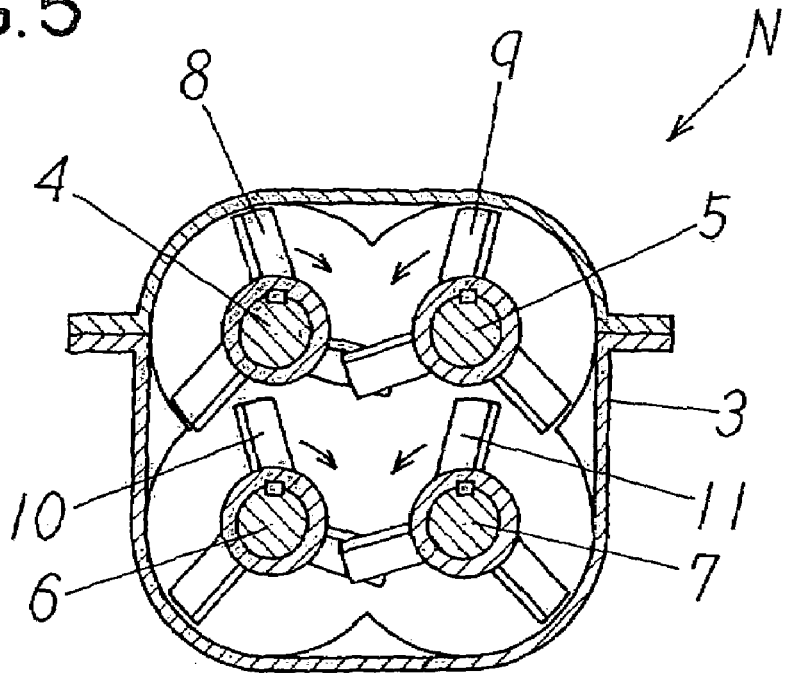
FIG. 5 is a schematic sectional view taken along line 5-5 in FIG. 2.
Figure 6:
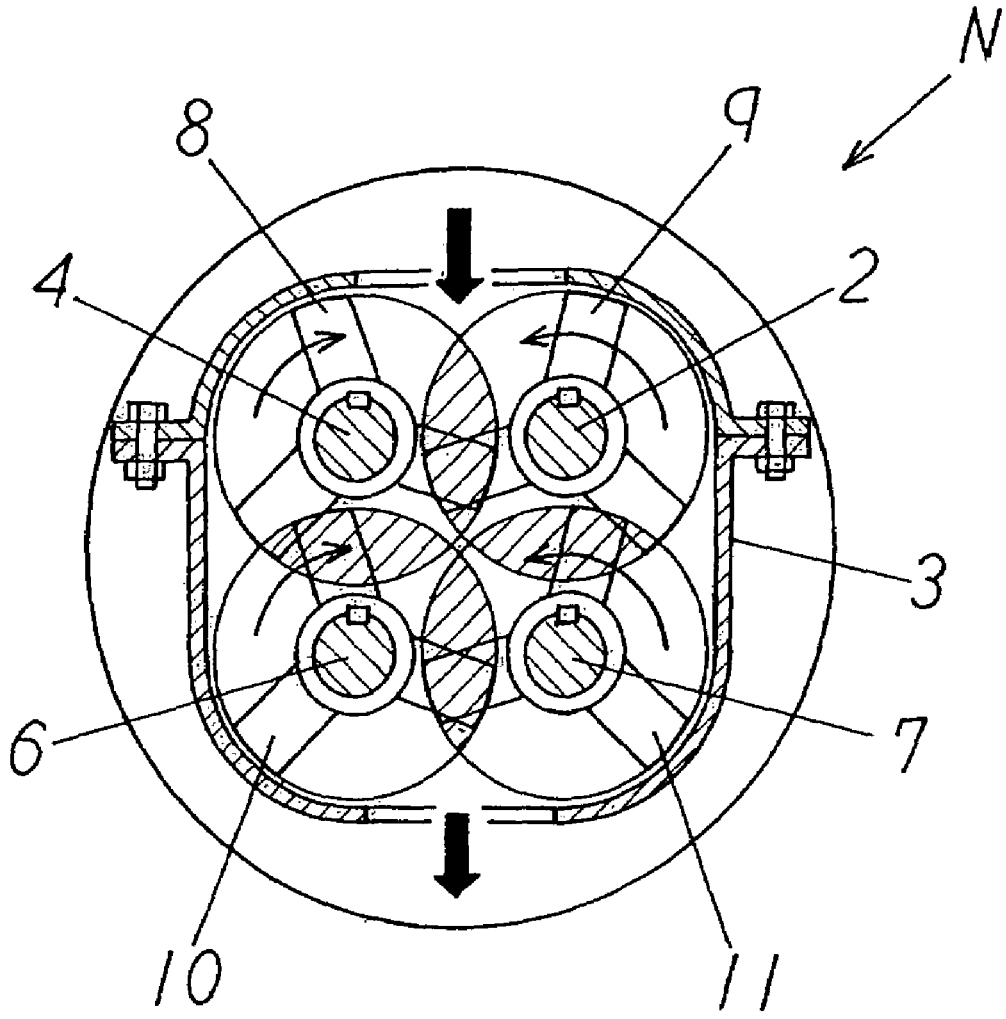
FIG. 6 is a schematic sectional view taken along line 6-6 in FIG. 2.

The casing 3 includes a papermaking material supply opening 3*a* and a papermaking material outlet 3*b* which is located lower than the papermaking material supply opening 3*a*. Inside the casing 3, as shown in FIGS. 4-6, first, second, third and fourth rotational shafts 4, 5, 6, 7 are provided. First, second, third and fourth blades 8, 9, 10, 11 for kneading are respectively provided on the first, second, third and fourth rotational shafts 4, 5, 6, 7. As shown in FIGS. 4-6, the first rotational shaft 4 and the second rotational shaft 5 are the same height (for example, the height from the bottom surface of the casing 1 is the same) and in parallel with each other. The third rotational shaft 6 and the fourth rotational shaft 7 are the same height (for example, the height from the bottom surface of the casing 1 is the same) and in parallel with each other. The third rotational shaft 6 is located under the first rotational shaft 4 and the fourth rotational shaft 7 is located under the second rotational shaft 5, respectively. Therefore, the volume of the space, where the papermaking material is processed, can be increased without increasing the installation space of the bottom portion of the kneader N.

Incidentally, in the embodiments, although a pair of rotational shafts (4 and 5, or 6 and 7) are arranged in two levels, the invention is not limited to the embodiments described hereinabove, and can have more than two levels as long as at least the first, second, third and fourth rotational shafts 4, 5, 6, 7 are provided within the casing 3. Also, overheated steam is supplied to the casing 3 through an overheated steam supply channel which is not shown in the figures.

Figure 7:
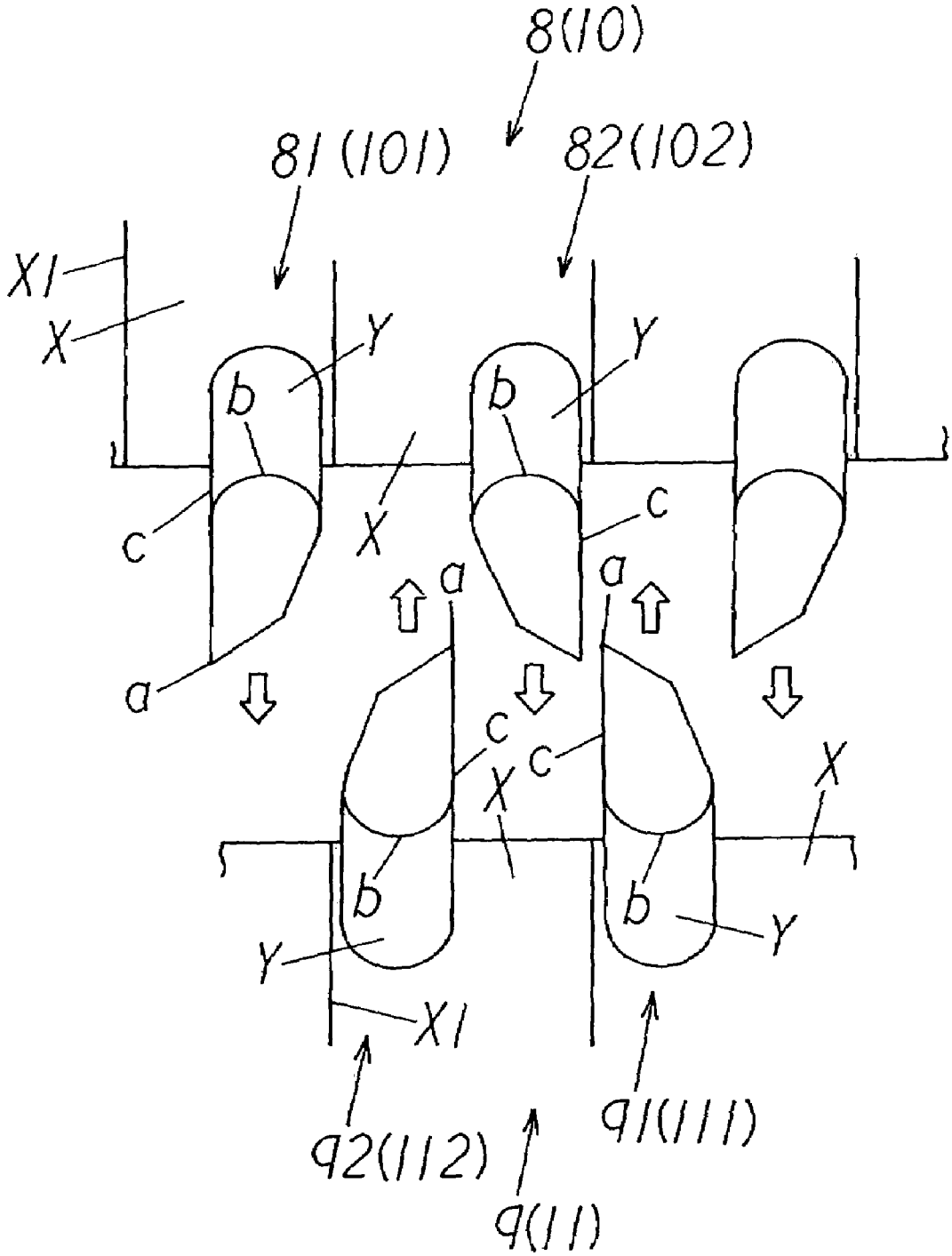
FIG. 7 is a schematic partial plan view of FIG. 6.
Figure 8:
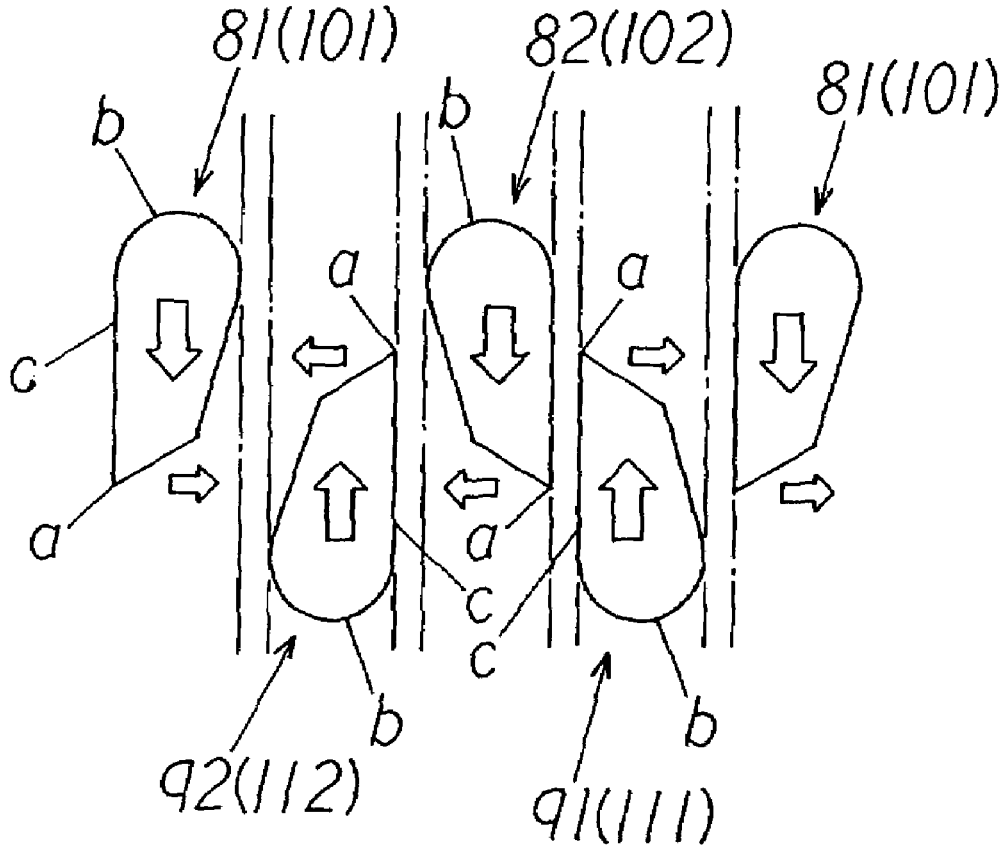
FIG. 8 is a schematic explanatory drawing for explaining the operation of blades of the kneader in FIG. 1.

Each first blade 8 is configured by, for example, first feed blades (feed arbitrary or feed guide blades) 81 and first return blades (return arbitrary or return guide blades) 82 which are alternately attached to the first rotational shaft 4 (refer to FIG. 7). The first feed blades 81 guide the papermaking materials from a papermaking material supply opening 3*a* side to a papermaking material outlet 3*b* side. Conversely, the first return blades 82 guide the papermaking materials to return from the papermaking material outlet 3*b* side to the papermaking material supply opening 3*a* side.

More specifically, the first feed blades 81 and the first return blades 82 have tube members X attached to the first rotational shaft 4; and blades Y made of a bar-like member with a wing-shaped cross section which are attached to the tube members X. The wing-shaped blades Y have a tapered shape from back end portions b to front end portions a, and flat surfaces c which are parallel to end surfaces X1 of the tube members X are formed along the blades Y. The first feed blades 81 are attached to the first rotational shaft 4 in such a way that the flat surfaces c face the upstream side of the papermaking materials, and the first return blades 82 are attached to the first rotational shaft 4 in such a way that the flat surfaces c face the downstream side of the papermaking materials, respectively. In addition, the front end portions a are located in front of the back end portions b relative to a rotational direction of the blades Y.

Each second blade 9 is configured by, for example, second feed blades (feed arbitrary or feed guide blades) 91 and second return blades (return arbitrary or return guide blades) 92 which are alternately attached to the second rotational shaft 5 (refer to FIG. 7). As in the case of the first feed blades 81, the second feed blades 91 guide the papermaking materials from the papermaking material supply opening 3*a* side to the papermaking material outlet 3*b* side. Conversely, the second return blades 92 guide the papermaking materials to return from the papermaking material outlet 3*b* side to the papermaking material supply opening 3*a* side.

More specifically, the second feed blades 91 and the second return blades 92 have the tube members X attached to the second rotational shaft 5; the blades Y made of a bar-like member with a wing-shaped cross section which are attached to the tube members X. The wing-shaped blades Y have a tapered shape from back end portions b to front end portions a, and flat surfaces c which are parallel to the end surfaces X1 of the tube members X are formed along the blades Y. The second feed blades 91 are attached to the second rotational shaft 5 in such a way that the flat surfaces c face the upstream side of the papermaking materials, and the second return blades 92 are attached to the second rotational shaft 5 in such a way that the flat surfaces c face the downstream side of the papermaking materials, respectively. In addition, the front end portions a are located in front of the back end portions b relative to the rotational direction of the blades Y.

Each third blade 10 is configured by, for example, third feed blades (feed arbitrary or feed guide blades) 101 and third return blades (return arbitrary or return guide blades) 102 which are alternately attached to the third rotational shaft 6 (refer to FIG. 7). More specifically, the third feed blades 101 and the third return blades 102 have tube members X attached to the third rotational shaft 6; and blades Y made of a bar-like member with a wing-shaped cross section which are attached to third tube members X. The wing-shaped blades Y have a tapered shape from back end portions b to front end portions a, and flat surfaces c which are parallel to the end surfaces X1 of the tube members X are formed along the blades Y. The third feed blades 101 are attached to the third rotational shaft 6 in such a way that the flat surfaces c face the upstream side of the papermaking materials, and the third return blades 102 are attached to the third rotational shaft 6 in such a way that the flat surfaces c face the downstream side of the papermaking materials, respectively. In addition, the front end portions a are located in front of the back end portions b relative to the rotational direction of the blades Y.

Each fourth blade 11 is configured by, for example, fourth feed blades (feed arbitrary or feed guide blades) 111 and fourth return blades (return arbitrary or return guide blades) 112 which are alternately attached to the fourth rotational shaft 7 (refer to FIG. 7). More specifically, the fourth feed blades 111 and the fourth return blades 112 have the tube members X attached to the fourth rotational shaft 7; and the blades Y made of a bar-like member with a wing-shaped cross section which are attached to the tube members X. The wing-shaped blades Y have a tapered shape from back end portions b to front end portions a, and flat surfaces c which are parallel to the end surfaces X1 of the tube members X are formed along the blades Y. The fourth feed blades 111 are attached to the fourth rotational shaft 7 in such a way that the flat surfaces c face the upstream side of the papermaking materials, and the fourth return blades 112 are attached to the fourth rotational shaft 7 in such a way that the flat surfaces c face the downstream side of the papermaking materials, respectively. In addition, the front end portions a are located before the back end portions b relative to the rotational direction of the blades Y.

As mentioned above, the blades have the tube members X attached to the rotational shafts and the blades Y attached to the tube members X. The blades Y have a tapered shape from the back end portions b to the front end portions a, and the flat surfaces c which are parallel to the end surfaces X1 of the tube members X are formed along the blades Y. By turning directions of the blades Y alternately, the feed blades and the return blades can be shared and also easily configured. In addition, M1, M2, M3, M4 shown in FIG. 4 represent key grooves, and K1, K2, K3, K4 represent keys. By passing the keys K1, K2, K3, K4 through the key grooves M1, M2, M3, M4, the first, second, third and fourth rotational shafts 4, 5, 6, 7 and the first, second, third and fourth blades 8, 9, 10, 11 are fixed.

Figure 1:
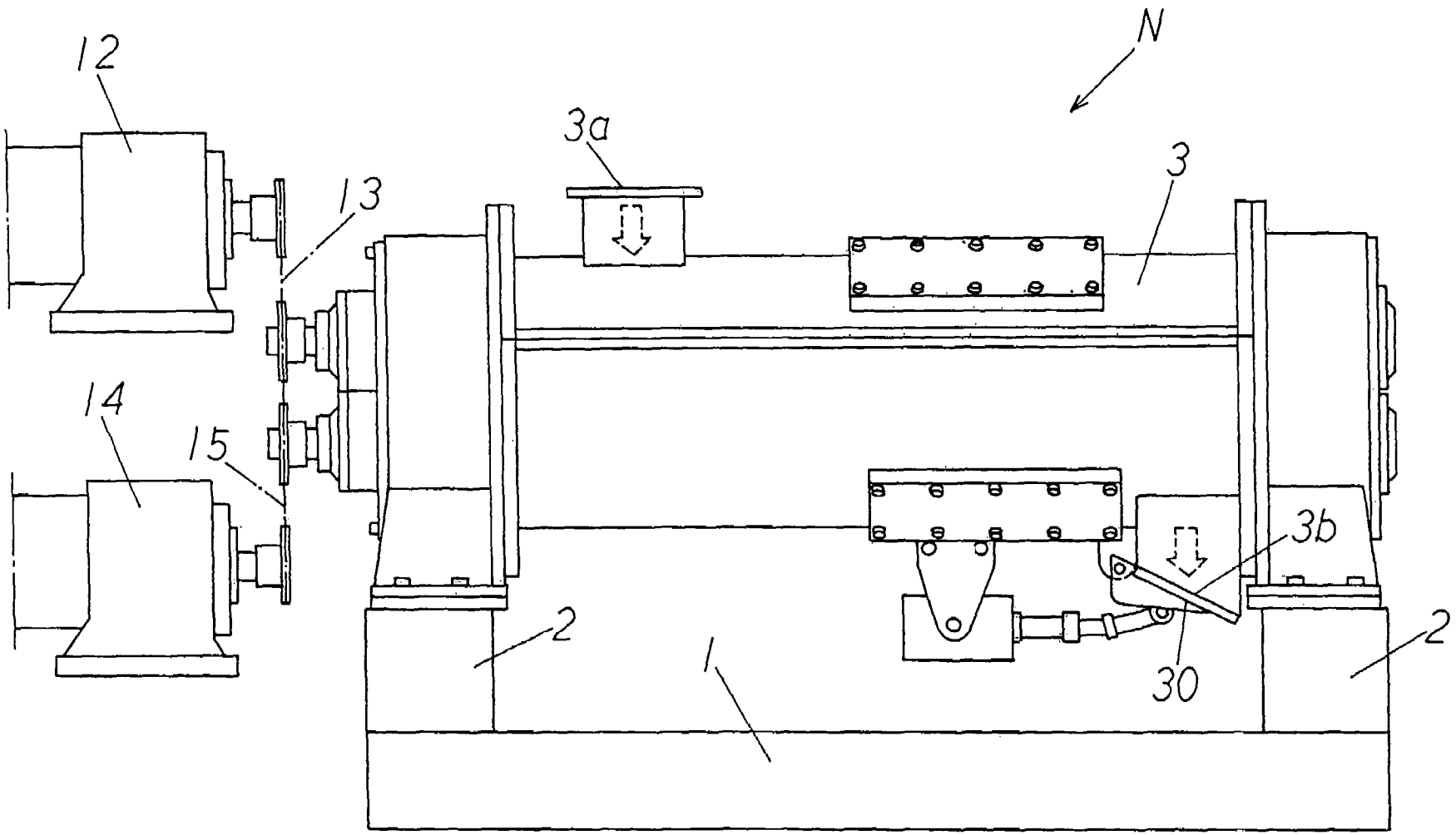
FIG. 1 is a schematic front view of a kneader according to an embodiment of the invention.
Figure 2:
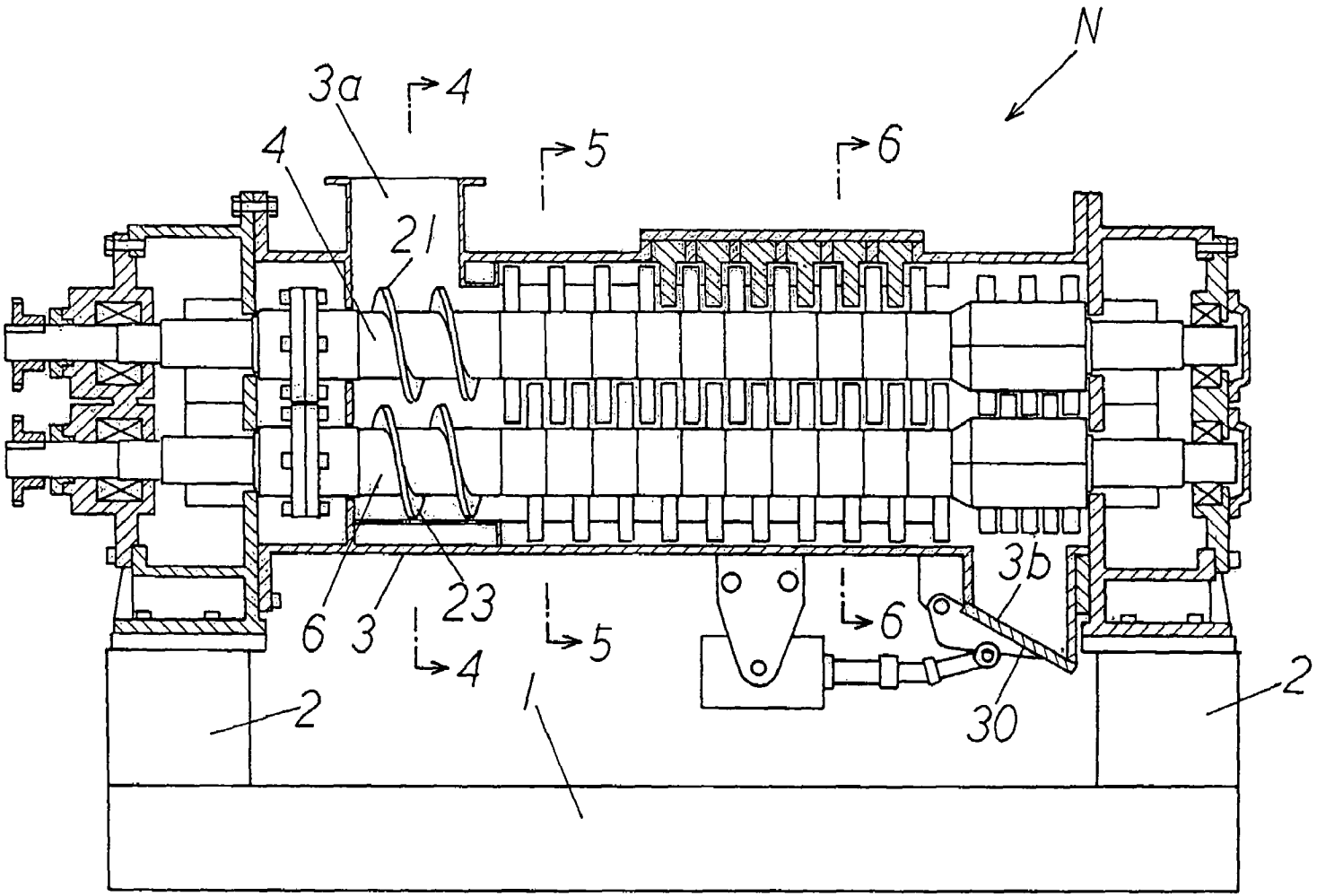
FIG. 2 is a schematic longitudinal sectional view of FIG. 1.
Figure 3:
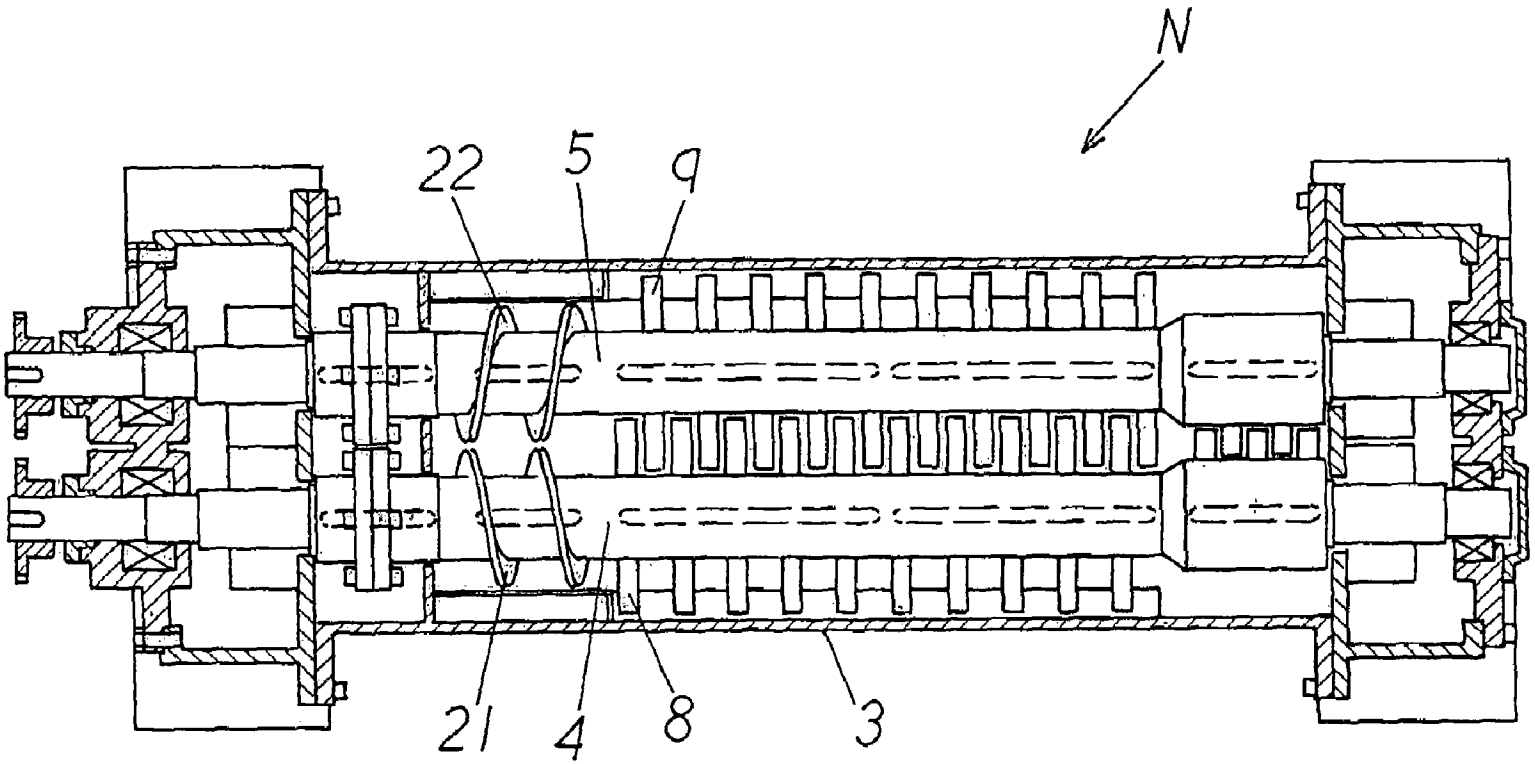
FIG. 3 is a schematic horizontal sectional view of FIG. 1.

The first rotational shaft 4 and the second rotational shaft 5 rotate differently with each other through a first motor 12, a chain 13 and a gear which is not shown in the figure (refer to FIG. 1). The third rotational shaft 6 and the fourth rotational shaft 7 rotate differently with each other through a second motor 14, a chain 15 and a gear which is not shown in the figure. As shown in FIG. 6, for example, rotational directions of the first rotational shaft 4 and the third rotational shaft 6 are clockwise, and rotational directions of the second rotational shaft 5 and the fourth rotational shaft 7 are counterclockwise. Incidentally, in the embodiment, the rotational directions of the first rotational shaft 4 and the third rotational shaft 6 are clockwise and the rotational directions of the second rotational shaft 5 and the fourth rotational shaft 7 are counterclockwise. However, the rotational directions and rotational frequency of the first, second, third and fourth rotational shafts 4, 5, 6, 7 may be controlled accordingly by a control means which is not shown in the figure. As shown in FIG. 5, in the embodiment, the first, second, third and fourth blades 8, 9, 10, 11 for kneading which are provided in the first, second, third and fourth rotational shafts 4, 5, 6, 7 have three blades respectively. However, the blades 8, 9, 10, 11 may be configured accordingly in the range of three to six blades.

Under the papermaking material supply opening 3*a*, screws 21, 22, 23, 24 sending the papermaking materials are respectively provided on the side of the first rotational shaft 4 and the second rotational shaft 5 and on the side of the third rotational shaft 6 and the fourth rotational shaft 7 (refer to FIGS. 1-4). An opening-and-closing lid 30 which opens and closes the papermaking material outlet 3*b* is provided in the papermaking material outlet 3*b*, and the papermaking material outlet 3*b* is closed by the opening-and-closing lid 30, so that a constant amount of papermaking materials is accumulated inside the casing 3 and kneaded. After the papermaking materials inside the casing 3 are kneaded, the opening-and-closing lid 30 is opened and the kneaded papermaking materials are discharged to the outside of the casing 3.

Therefore, if the papermaking materials such as the used paper and the waste sheet are supplied from the papermaking material supply opening 3*a* in a state where the papermaking material outlet 3*b* is closed by the opening-and-closing lid 30, the papermaking materials are guided to a first rotational shaft 4 and second rotational shaft 5 side by the screws 21, 22, and the papermaking materials which passed between the screws 21, 22 are guided to a first rotational shaft 6 and second rotational shaft 7 side by the screws 23, 24, respectively. The papermaking materials which were guided to the first rotational shaft 4 and second rotational shaft 5 side are kneaded by the first blade 8 and the second blade 9, and the papermaking materials which were guided to the third rotational shaft 6 and fourth rotational shaft 7 side are kneaded by the third blade 10 and the fourth blade 11, respectively (refer to FIG. 6). Especially, the first feed-blade 81 and the second return blade 92; the first return blade 82 and the second feed blade 91; the third feed blade 101 and the fourth return blade 112; and the third return blade 102 and the fourth feed blade 111 are arranged to face each other, respectively. Accordingly, the papermaking materials do not pass through smoothly, so that the papermaking materials stay longer inside the casing 3 and are kneaded more by the blades. As a result, the papermaking materials are kneaded more reliably (refer to FIG. 8).

In addition, when the papermaking materials which passed between the pair of first rotational shaft 4 and second rotational shaft 5 move between the pair of third rotational shaft 6 and fourth rotational shaft 7, the papermaking materials are kneaded by the first blade 81, the third blade 101, the second blade 91 and the fourth blade 111. More specifically, the papermaking materials which are processed are also kneaded by the first blade 81 and the third blade 101; and the second blade 91 and the fourth blade 111 in addition to by the first blade 81 and the second blade 91; and the third blade 101 and the fourth blade 111 while the papermaking materials reach the papermaking material outlet 3*b*. As a result, the kneading effect can be also increased (refer to FIG. 6). As mentioned above, the papermaking materials such as the used paper and the waste sheet are kneaded by the kneader N, the used paper and the waste sheet are rubbed, and ink materials which are mixed in the papermaking materials (the ink materials are also subdivided) can be separated from the pulp. Also, the rest of the process can be processed, for example, the ink materials can be eliminated from the pulp by a flotator and so on.

The disclosure of Japanese Patent Application No. 2006-267501, filed on Sep. 29, 2006, is incorporated in the application.

While the invention has been explained with reference to the specific embodiments of the invention, the explanation is illustrative and the invention is limited only by the appended claims.

What is claimed is:

1. A kneader comprising:

a casing having a papermaking material supply opening and a papermaking material outlet located below the papermaking material supply opening;

at least first, second, third and fourth rotational shafts provided inside the casing;

first blades attached to the first rotational shaft;

second blades attached to the second rotational shaft;

third blades attached to the third rotational shaft; and fourth blades attached to the fourth rotational shaft, wherein the first rotational shaft and the second rotational shaft are disposed at the same height and are arranged parallel to each other, the third rotational shaft and the fourth rotational shaft are disposed at the same height and arranged parallel to each other, the third rotational shaft is located under the first rotational shaft and the fourth rotational shaft is located under the second rotational shaft, respectively, wherein the first blades comprise first feed blades and first return blades which are alternately attached to the first rotational shaft; the second blades comprise second feed blades and second return blades which are alternately attached to the second rotational shaft; the third blades comprise third feed blades and third return blades which are alternately attached to the third rotational shaft; and the fourth blades comprise fourth feed blades and fourth return blades which are alternately attached to the fourth rotational shaft, and wherein each of the feed blades feeds a papermaking material from a side of the supply opening to a side of the outlet, and each of the return blades returns the papermaking material from the side of the outlet to the side of the supply opening so that when the papermaking material is transferred by the first to fourth blades, the papermaking material is not smoothly transferred from the supply opening to the outlet and can stay longer in the casing.

2. A kneader according to claim 1, wherein the first to fourth blades are arranged such that the first feed blades and the second return blades face each other; the first return blades and the second feed blades face each other; the third feed blades and the fourth return blades face each other; the third return blades and the fourth feed blades face each other; the first feed blades and the third return blades face each other; the first return blades and the third feed blades face each other; the second feed blades and the fourth return blades face each other; and the second return blades and the fourth feed blades face each other.

3. A kneader according to claim 2, wherein each of the first feed blade and the first return blade includes a tube member attached to the first rotational shaft, a blade attached to the tube member, each blade having a tapered shape from a back end portion to a front end portion thereof, and a flat surface parallel to an end surface of the tube member along the blade; the first feed blade is attached to the first rotational shaft in such a way that the flat surface faces an upstream side of flow of the papermaking material; and the first return blade is attached to the first rotational shaft in such a way that the flat surface faces a downstream side of the flow of the papermaking material.

4. A kneader according to claim 3, wherein each of the second feed blade and the second return blade includes a tube member attached to the second rotational shaft, a blade attached to the tube member, each blade having a tapered shape from a back end portion to a front end portion thereof, and a flat surface parallel to the end surface of the tube member along the blade; the second feed blade is attached to the second rotational shaft in such a way that the flat surface faces the upstream side of the flow of the papermaking material; and the second return blade is attached to the second rotational shaft in such a way that the flat surface faces the downstream side of the flow of the papermaking material.

5. A kneader according to claim 4, wherein each of the third feed blade and the third return blade includes a tube member attached to the third rotational shaft, a blade attached to the tube member, each blade having a tapered shape from a back end portion to a front end portion thereof, and a flat surface parallel to the end surface of the tube member along the blade; the third feed blade is attached to the third rotational shaft in such a way that the flat surface faces the upstream side of the flow of the papermaking material; and the third return blade is attached to the third rotational shaft in such a way that the flat surface faces the downstream side of the flow of the papermaking material.

6. A kneader according to claim 5, wherein each of the fourth feed blade and the fourth return blade includes a tube member attached to the fourth rotational shaft, a blade attached to the tube member, each blade having a tapered shape from a back end portion to a front end portion thereof, and a flat surface parallel to the end surface of the tube member along the blade; the fourth feed blade is attached to the fourth rotational shaft in such a way that the flat surface faces the upstream side of the flow of the papermaking material; and the fourth return blade is attached to the fourth rotational shaft in such a way that the flat surface faces the downstream side of the flow of the papermaking material.

7. A kneader according to claim 1, wherein each of the first to fourth feed blades has a bar shape tapered from a back end portion to a front end portion, and a flat surface facing the side of the supply opening; and each of the first to fourth return blades has a bar shape tapered from a back end portion to a front end portion, and a flat surface facing the side of the outlet.

8. A kneader according to claim 7, wherein in each of the first to fourth blades on the first to fourth rotational shafts, the flat surface of the feed blade faces the flat surface of the return blade with a space therebetween in which the blade on the adjacent shaft enters.

9. A kneader according to claim 8, wherein each of the first to fourth shafts further includes a screw under the supply opening for supplying the papermaking material toward the outlet.

* * * * *